US005126800A

United States Patent [19]

Shishido et al.

[11] Patent Number: 5,126,800

[45] Date of Patent: Jun. 30, 1992

[54] PROCESS CARTRIDGE AND IMAGE FORMING APPARATUS USABLE WITH SAME FEATURING SELECTIVELY ENGAGEABLE DRIVE MECHANISM

[75] Inventors: Kazuo Shishido; Tadayuki Tsuda, both of Kawasaki; Makoto Tanaka, Tokyo; Shinichi Sasaki, Fujisawa; Takashi Hibi, Yokohama, all of Japan

[73] Assignee: Cannon Kabushiki Kaisha, Tokyo, Japan

[21] Appl. No.: 656,970

[22] Filed: Feb. 19, 1991

[30] Foreign Application Priority Data

Feb. 17, 1990 [JP] Japan ..... 2-036718
Feb. 23, 1990 [JP] Japan ..... 2-041170

[51] Int. Cl.[5] ..... G93G 15/00

[52] U.S. Cl. ..... 355/211; 355/245; 355/200

[58] Field of Search ..... 355/200, 210, 211, 245

[56] References Cited

U.S. PATENT DOCUMENTS 4,829,335 5/1989 Kanemitsu et al. ..... 355/211

FOREIGN PATENT DOCUMENTS 1-145667 6/1989 Japan ..... 355/200

*Primary Examiner*—Joan H. Pendegrass
*Attorney, Agent, or Firm*—Fitzpatrick, Cella, Harper & Scinto

[57] ABSTRACT

A process cartridge detachably mountable to an image forming apparatus includes a movable image bearing member having first and second drive transmitting portions; a developer carrying member for carrying a developer to supply the developer to the image bearing member, the developer carrying member having a third drive transmitting portion; wherein the third drive transmitting portion is selectively engageable with a first drive transmitting portion and a second drive transmitting portion.

20 Claims, 4 Drawing Sheets

PROCESS CARTRIDGE AND IMAGE FORMING APPARATUS USABLE WITH SAME FEATURING SELECTIVELY ENGAGEABLE DRIVE MECHANISM

FIELD OF THE INVENTION AND RELATED ART

The present invention relates to an image forming apparatus such as an electrophotographic copying machine or an electrophotographic printer, and more particularly to a process cartridge detachably mountable to such an image forming apparatus.

In conventional image forming machines such as electrophotographic copying machine or electrophotographic printer, images are repeatedly formed by repeating the process steps including charging a photosensitive member (image bearing member), exposing it to image light, developing the image into a toner image, transferring the toner image onto a transfer material, and cleaning the photosensitive member.

In a modern image forming machine, the image bearing member and at least one of process means such as a charger, a developing device and a cleaner actable on the image bearing member, are constituted as a unit detachably mountable to the image forming apparatus.

Particularly, a personal use type copying machine of the process cartridge type is usable with different process cartridges such as a process cartridge having a developer containing black developer and a process cartridge having a developing device containing a chromatic color developer such as red, blue or green developer. Such different process cartridges are usable with the same copying machine to permit image formations in different colors.

The black developer may be a magnetic developer, but the chromatic color developer is preferably non-magnetic developer because of the coloring of the developer. For this reason or another, the developing conditions may be different depending on the material of the developer. In addition, it is preferable, as the case may be, that the rotational speed of the developing sleeve is different when the developer is magnetic and when the developer is non-magnetic.

If different speeds are used, and if the driving force is transmitted from the image bearing member to the developing sleeve, a gear train would be used to provide a different gear ratio, and therefore, a different rotational speed of the developing sleeve.

However, the provision of the gear train requires a greater number of parts such as gears, gear shafts and bearings therefor, with the result of bulkiness and cost increase of the process cartridge. In addition, the increase of the number of gears results in greater noise and greater loss of the drive transmission.

SUMMARY OF THE INVENTION

Accordingly, it is a principal object of the present invention to provide a process cartridge wherein the drive can be transmitted with a simple structure from an image bearing member to a developer carrying member such as a developing sleeve of developing means.

It is another object of the present invention to provide a process cartridge in which the rotational speed of the developer carrying member is different depending on the material of the developer.

It is a further object of the present invention to provide a process cartridge wherein an image bearing member is usable commonly with plural different process cartridges.

It is a yet further object of the present invention to provide a process cartridge having a small size and be able to be manufactured at low cost.

It is a further object of the present invention to provide a process cartridge wherein the drive transmission efficiency is high with a suppressed noise level in use.

It is a further object of the present invention to provide an image forming apparatus usable with such a process cartridge.

While the invention has been described with reference to the structures disclosed herein, it is not confined to the details set forth and this application is intended to cover such modifications or changes as may come within the purposes of the improvements or the scope of the following claims.

The invention in one aspect pertains to a process cartridge detachably mountable to an image forming apparatus, comprising a movable image bearing member having first and second drive transmitting portions, and a developer carrying member for carrying a developer to supply the developer to the image bearing member. The developer carrying member has a third drive transmitting portion that is engageable with one of the first drive transmitting portion and the second drive transmitting portion.

The invention in a further aspect pertains to an image forming apparatus, comprising a process cartridge detachably mountable to an image forming apparatus, comprising a movable image bearing member having first and second drive transmitting portions, a developer carrying member for carrying a developer to supply the developer to the image bearing member. The developer carrying member has a third drive transmitting portion that is engageable with one of the first drive transmitting portion and the second drive transmitting portion. Supporting means detachably supports the process cartridge. A driving means is engageable with one of the first and second drive transmitting means of the image bearing member to transmitting driving force to the process cartridge when the process cartridge is mounted in the image bearing member.

DESCRIPTION OF THE PREFERRED EMBODIMENTS

Figure 1:
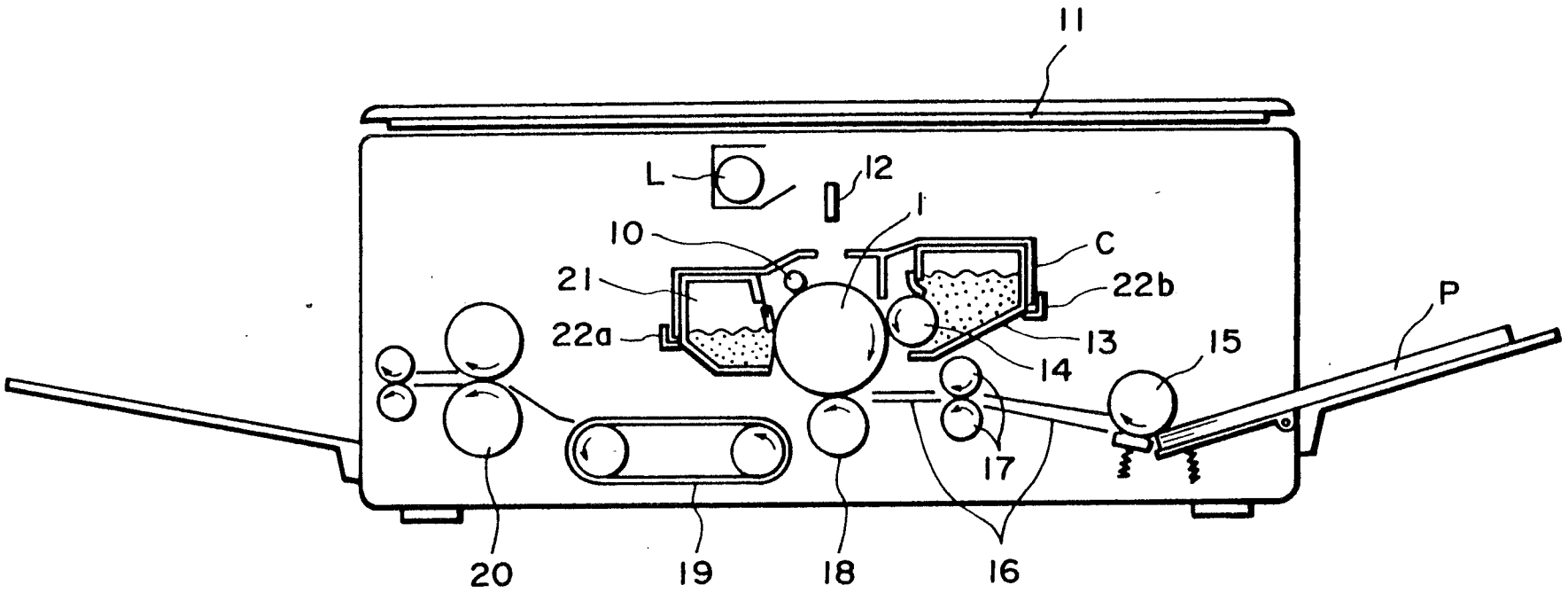
FIG. 1 is a sectional view of an electrophotographic copying machine as an exemplary image forming apparatus according to the present invention.

Referring first to FIG. 1, there is shown an electrophotographic copying machine as an exemplary image forming apparatus usable with the process cartridge according to an embodiment of the present invention.

A photosensitive drum (image bearing member) 1 rotates in a direction indicated by an arrow. The photosensitive drum 1 is uniformly charged by a charging roller (charging means) 10 which may be as disclosed in U.S. Pat. No. 4,851,960. An original supported on a movable original platen 11 is illuminated by a light source L, and the light image therefrom is projected onto the photosensitive drum 1 through an optical element 12, so that an electrostatic latent image is formed on the photosensitive drum 1. The electrostatic latent image is developed with toner particles on a developing sleeve (developer carrying member) 14 of a developing device 13.

On the other hand, a recording material P is supplied by a pick-up roller 15. The recording material P is fed along a conveyance guide 15 and a pair of registration rollers 17 into a nip formed between the photosensitive drum 1 and a transfer roller 18 rotatable in contact with the photosensitive drum 1.

The toner image is transferred from the photosensitive drum 1 into the recording material P by the transfer roller 18. The recording material P now having the toner image is conveyed on a conveying belt 19 to an image fixing apparatus, where the toner image is fixed thereon. Finally, the recording material P is discharged outside the machine.

After the image transfer, the photosensitive drum 1 is cleaned by a cleaning device so that the remaining toner is removed, by which the photosensitive drum 1 is prepared for the next image forming operation.

In this embodiment, the photosensitive drum 1, the charging roller 10, the developing device 13 and the cleaning device 21 (process means) are constituted as a unit (process cartridge C). The process cartridge C is detachably mountable into the main assembly of the copying machine along guides 22*a* and 22*b*.

Figure 2A:
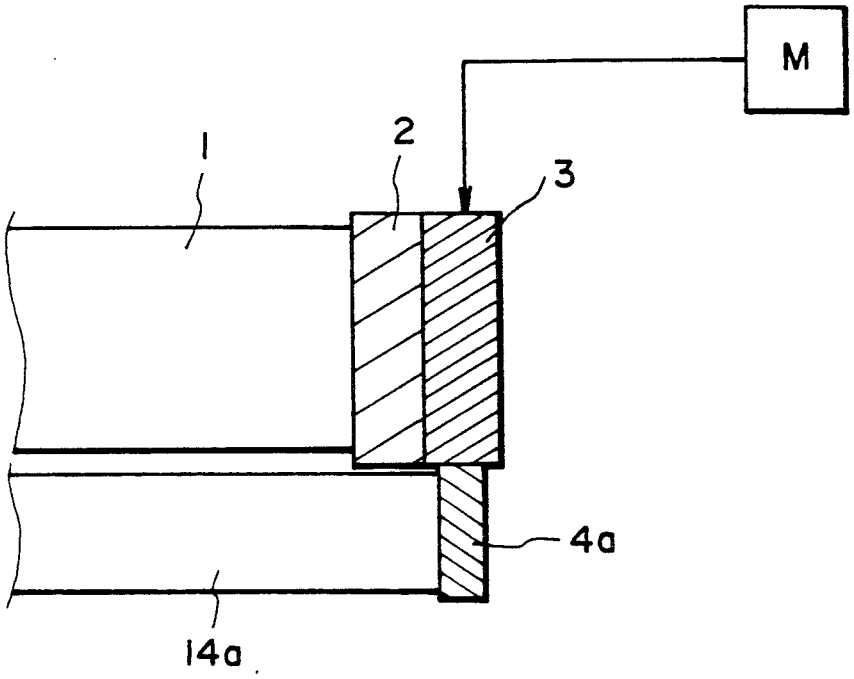
FIGS. 2A and 2B are top plan views of major parts for the drive transmission between a photosensitive drum and a developing sleeve, according to the embodiment of the present invention.
Figure 2B:
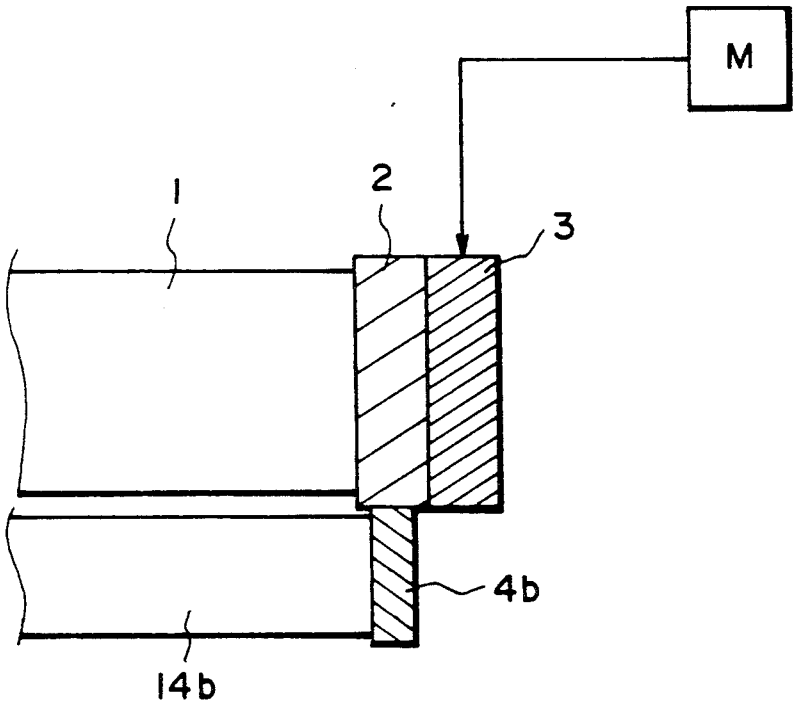

Referring to FIGS. 2A and 2B, the drive transmission exists between the image bearing member (photosensitive drum) and the developer carrying member (developing sleeve). Adjacent a longitudinal end of the photosensitive drum 1, there are a first drum flange gear 2 and a second drum flange gear 3 (drive transmitting portion). The gears 2 and 3 are integrally molded with plastic resin material. The flange having the gears is securedly fixed to the basic member of the drum cylinder by suitable means such as press-fitting or by bonding agent, for example.

Developing sleeves 14*a* and 14*b* have respective sleeve gears 4*a* and 4*b* at the respective longitudinal ends. The sleeve gears 4*a* and 4*b* are meshable with the drum flange gears 2 and 3, respectively. Similarly to the drum flange gears, the sleeve gears are securedly fixed to the respective sleeve bodies by press-fitting, bonding or the like.

In this embodiment, FIG. 2A shows the process cartridge having a developing device containing a magnetic and one component developer. FIG. 2B shows a process cartridge having a developing device containing a non-magnetic one component developer. More particularly, the former process cartridge contains a back developer, whereas the latter process cartridge contains a red developer.

The description will be made as to the details of the developing devices. The structures of the process cartridges are the same except for the developing devices, and therefore, the detailed description thereof are omitted.

Figure 3A:
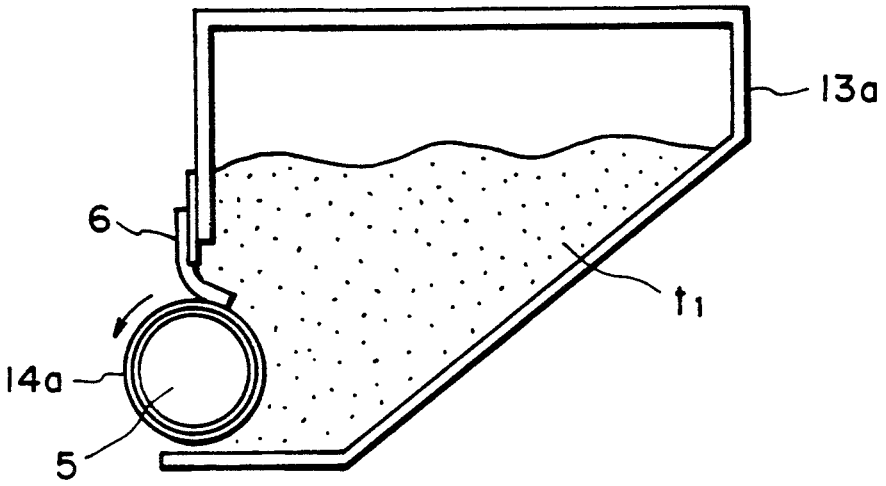
FIGS. 3A and 3B are sectional views of different developing devices.
Figure 3B:
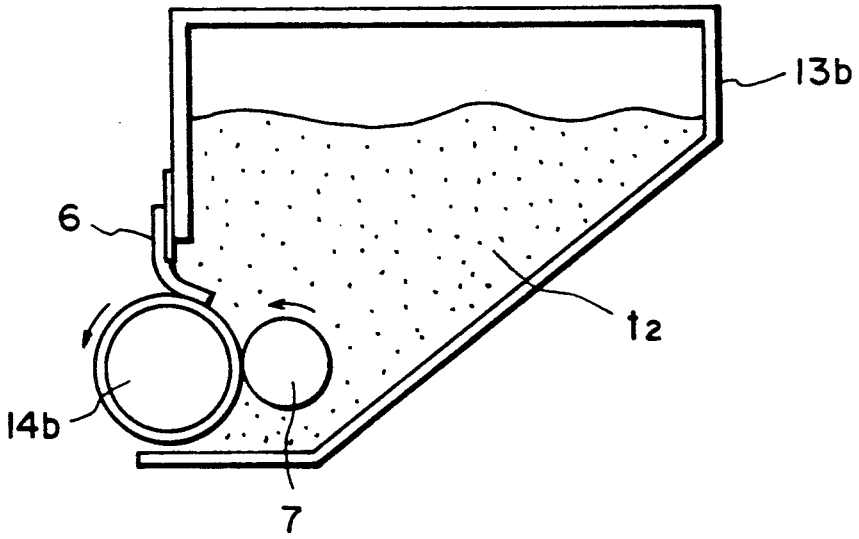

Referring to FIG. 3A, which is a sectional view of the developing device 13*a* containing a magnetic one component developer, a developing $t_1$ is applied on the developing sleeve 14*a* with the aid of the magnetic force of a magnet 5 disposed in the developing sleeve 14*a*. The thickness of the developer layer thereon is controlled by the pressure of contact between a regulating blade 6 of an elastic material and a developing sleeve 14*a*. The regulating blade is not limited to the elastic blade, but it may be of a type disclosed in U.S. Pat. No. 4,297,970 (magnetic blade). FIG. 3B is a sectional view of a developing device 13*b* containing the non-magnetic one component developer. The developing sleeve 14*b* and the elastic roller 7 of a foam material are rotated in the directions of the arrows. The developer $t_2$ is introduced into between the two rotatable members, by which the triboelectric charge of the toner is increased by the rubbing action thereby, so that the developer is applied on the developing sleeve 14*b*. The thickness of the developer layer is controlled by the contact pressure present between the regulating blade 6 and the developing sleeve 14*b*.

Thus, the developing device 13*b* using the non-magnetic one component developer is provided with the elastic roller press-contacted to the developing sleeve for the purpose of triboelectric charging of the developer in addition to the elements employed in the developing device 13*a* using the magnetic one component developer. On the other hand, the developing device 13*b* is not provided with a magnet 5 for retaining the developing device on the developing sleeve in the developing device 13*a*. For the purpose of preventing scattering of the developer which cannot be controlled by the magnetic force and for another purpose, the contact pressure present between the regulating blade and the developing sleeve is made greater, and therefore, the thickness of the layer of the developer is thinner in the developing device 13*b* than in the developing device 13*a*. This increases the torque required for rotating the developing sleeve. Under the circumstances, the peripheral speed of the developing sleeve 14*b* of the developing device 13*b* using the non-magnetic one component developer is substantially equal to the peripheral speed of the photosensitive drum 1 in order to prevent the toner from scattering, to maintain the high image quality and to reduce the required torque, while the peripheral speed of the developing sleeve 14*a* of the developing device 13*a* using the magnetic one component developer is approximately 1.5 times the peripheral speed of the photosensitive drum 1. In other words, the rotational speed of the developing sleeve is lower in the case of the non-magnetic developer than in the case of the magnetic developer.

Because of the different developing system and different characteristics of the developer, the lower rotating speed of the developing sleeve does not influence the image quality.

For the purpose of providing the different peripheral speed difference of the developing sleeve in accordance with the developer used, it would be considered that the developing sleeve used with the magnetic one component developer is directly driven by a flange gear of the photosensitive drum so that it is rotated at a speed approximately 1.5 timed the drum peripheral speed, whereas the developing sleeve used with the non-magnetic one component developer is driven by the same flange gear of the photosensitive drum but through a gear train so that the gear ratio is reduced to $\frac{2}{3}$.

However, the use of gear train would result in the problems described hereinbefore.

In this embodiment, the selective drive for the developing sleeves from the common photosensitive drum at different speeds is accomplished by the structure shown in FIGS. 2A and 2B.

More particularly, in FIG. 2A, the photosensitive drum 1 is driven by driving means M of an electrophotographic copying machine main assembly. The developing sleeve 14*a* is driven by the photosensitive drum 1 through a drum flange gear 13 and a sleeve gear 4*a*, whereas in FIG. 2B, the developing sleeve 14*b* is driven from the same photosensitive drum 1 but through a different drum gear 2 and a different sleeve gear 4*b*.

Here, the number Z1 of the teeth of the drum flange bear 2 is smaller than the number Z2 of the teeth of the drum flange gear 3. The outer diameter of the gears are the same. Therefore, the rotational speed of the developing sleeve is lower when the non-magnetic one component developer is used than when the magnetic one component developer is used.

In this embodiment, the drum flange gear and the sleeve gear are in the form of helical gears, as disclosed in U.S. Pat. No. 4,829,335.

As described in the foregoing, the process cartridge containing as a unit the photosensitive drum and at least the developing device is, generally speaking, different if the developer of the developing device is different. Therefore, by selection of a gear of the photosensitive drum by the gear of the developing sleeve of the developing device, the developing sleeve may be driven at a proper rotational speed. Then, a common photosensitive drum is usable for different process cartridges.

In this embodiment, the developing sleeves and the sleeve gears therefore are common, and the sleeve peripheral speed is changed by the difference of the number of the teeth of the drum flange gear 3. However, modifications are possible, for example, the pitch circle diameters of the sleeve gears are made different, or the modules of the drum flange gears are made different, in order to provide different driving performances.

In addition, the outer diameters of the developing sleeve may be made different in addition to the structure for changing the peripheral speed of the developing sleeve by selection of the drum gear.

Since the process cartridge having the developing device using the magnetic developer requires smaller load of the developing sleeve as compared with the non-magnetic developer case, and therefore, the diameter of the developing sleeve can be reduced. By reducing the outer diameter of the developing sleeve, the volume capacity of the developer of the developing device in the process cartridge can be increased.

An example will be described. The outer diameter of the photosensitive drum 1 is 24 mm; the number Z1 of the teeth of the flange gear 32 is 30; the number Z2 of the teeth of the flange gear 3 is 33; an outer diameter of the developing sleeve 14*a* is 12 mm; the number of the teeth of the sleeve gear 4*a* is 11; an outer diameter of the developing sleeve 14*b* is 16 mm; and the number of the teeth of the sleeve gear 4*b* is 19. The process cartridge having the magnetic developer has a sleeve gear 4*a* meshable with the flange gear 3, whereas the process cartridge containing the non-magnetic developer has a sleeve gear 4*b* meshable with the flange gear 2. The two different types of the process cartridges are detachably mountable to an electrophotographic copying machine. Good images were produced with either of the process cartridges.

In the above example, the developing sleeve 14*a* is rotated at the peripheral speed which is approximately 150% of the peripheral speed of the photosensitive drum, whereas the developing sleeve 14*b* is rotated at a peripheral speed which is approximately 105% of the peripheral speed of the photosensitive drum.

In each of the process cartridges, the developing method was as disclosed in U.S. Pat. No. 4,395,476. The distance between the sleeve and the drum of the developing device using the magnetic developer was approximately 300 microns, and the distance between the sleeve and the drum in the developing device using the non-magnetic developer was approximately 250 microns.

Figure 4:
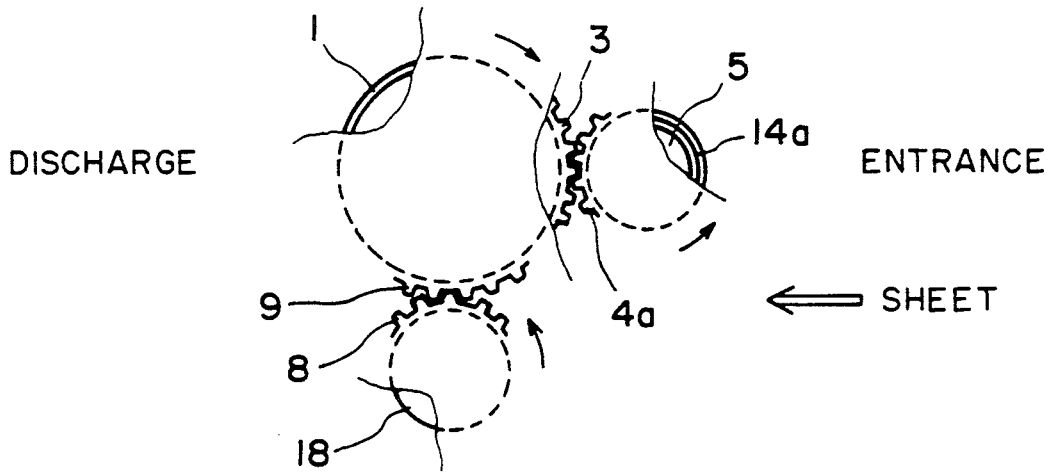
FIG. 4 is a partial sectional view of an apparatus according to a second embodiment of the present invention.

Referring to FIG. 4, a second embodiment of the present invention will be described. In the first embodiment, the flange of the photosensitive drum is provided with two gears having different numbers of teeth to provide different peripheral speed of the developing sleeve by using different drum flange gears, depending on the materials of the developer. In the present embodiment, the flange of the photosensitive drum 1 has three gears having different numbers of teeth. Two of the gear portions 2 and 3 are used for driving the photosensitive drum as in the first embodiment. The rest of the gears, that is, a gear portion 9 is used to drive the image transfer roller 18 by meshing engagement with a gear 8 of the transfer roller 18. In this case, the drive is used to feed the recording material.

In this embodiment, the transfer roller is driven, but it is possible that the drum flange gear is used to drive a conveyer belt or a conveying roller.

In this embodiment, a third gear is used for driving the transfer roller, but it is a possible alternative that one of the drum flange gears 2 and 3 in the first embodiment is used to drive the transfer roller, as well as, the developing sleeve.

Figure 5A:
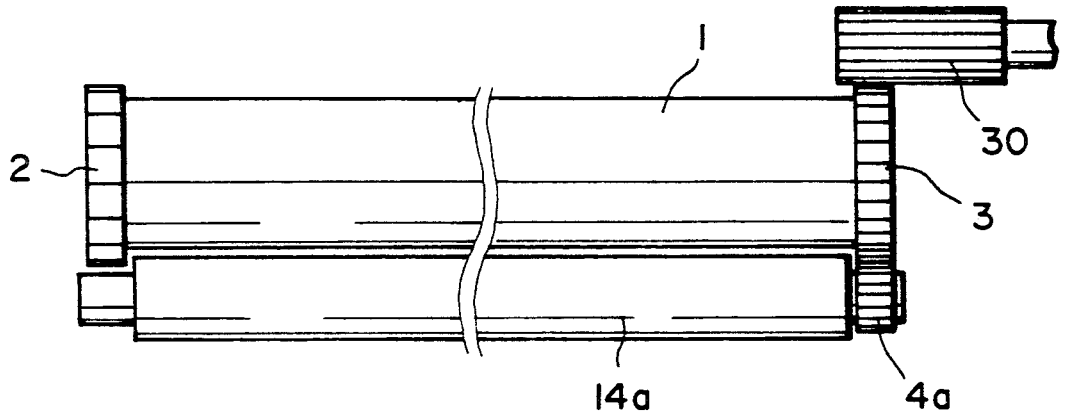
FIGS. 5A and 5B are top plan views illustrating a drive transmission between the photosensitive drum and the developing sleeve in an apparatus according to a third embodiment of the present invention.
Figure 5B:
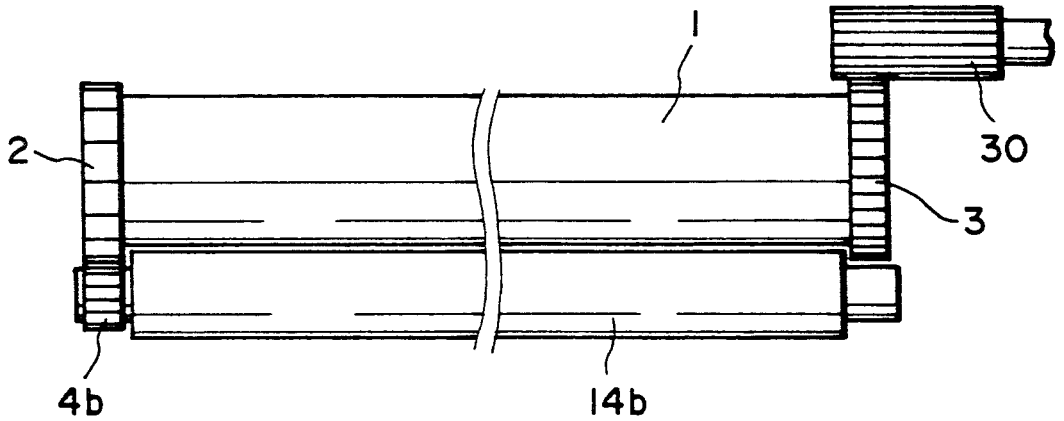

In FIGS. 2A and 2B, the plural drive transmitting portions are provided adjacent a longitudinal end of the photosensitive drum. As shown in FIGS. 5A and 5B, the flange gears 2 and 3 which are shown in this example as spur gears, are provided at opposite ends of the photosensitive drum 1 to drive the developing sleeves 14*a* and 14*b*, respectively. In the Figures, designated by a reference numeral 30 is a driving gear at the main assembly side to couple with a driving means M of the main assembly of the electrophotographic copying machine. It is meshed with the drum flange gear 3 to drive the photosensitive drum 1.

The structure of the process cartridge of this invention is not limited to those described in the foregoing, but it may be of a type disclosed in U.S. Ser. Nos. 580,563 and U.S. Patent Application Claiming the Convention Priority of Japanese patent Application No. 324090/1989.

As described in the foregoing, according to the present invention, the image bearing member such as a photosensitive drum is provided with plural drive transmitting portions (gear portions) having different driving performances. Therefore, gear trains or other parts are not required for changing the speed, so that the space required is reduced. The reduction of the number of parts is effective to reduce the cost. In addition, the drive transmission efficiency is increased. The reduction of the number of drive transmitting members is effective to reduce the noise level.

In addition, the structure other than the developing device can be made common, and therefore, the present invention is advantageous when plural kinds of the process cartridges are prepared.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to an image forming apparatus, comprising:

a movable image bearing member having first and second drive transmitting portions;

a developer carrying member for carrying a developer to supply the developer to said image bearing member, said developer carrying member having a third drive transmitting portion; and wherein said third drive transmitting portion is engageable with one of said first drive transmitting portion and said second drive transmitting portion.

2. A process cartridge according to claim 1, wherein said first and second drive transmitting portions are provided adjacent an end of said image bearing member.

3. A process cartridge according to claim 1 or 2, wherein said first and second drive transmitting portions have different drive transmitting means.

4. A process cartridge according to claim 3, wherein said first and second drive transmitting portions have respective gears having different numbers of teeth.

5. A process cartridge according to claim 3, wherein a different peripheral speed of said developer carrying member is provided when the second drive transmitting portion is engaged with the third drive transmitting portion than when the first drive transmitting portion is engaged with the third drive transmitting portion.

6. A process cartridge according to claim 1, wherein when the process cartridge is mounted in said image forming apparatus, one of said first and second drive transmitting portions is engaged with driving means of said image forming apparatus to permit drive transmission from the driving means.

7. A process cartridge according to claim 1, wherein at least one of the first and second drive transmitting portions drives means in said image forming apparatus.

8. A process cartridge according to claim 7, wherein said means of said image forming apparatus is an image transfer rotatable member.

9. A process cartridge according to claim 1, further comprises means for charging said image bearing member and means for cleaning said image bearing member.

10. A process cartridge according to claim 1, wherein the selective engagement is dependent on the developer contained in said process cartridge.

11. A process cartridge according to claim 1, wherein the selective engagement is dependent on whether the developer contains in said process cartridge is magnetic or non-magnetic.

12. A process cartridge according to claim 11, wherein the process cartridge containing the non-magnetic developer includes an elastic member press-contacted to said developer carrying member to supply the developer to said developer carrying member and an elastic member press-contacted to said developer carrying member to regulate a thickness of a layer of the developer on said developer carrying member.

13. A process cartridge according to claim 11, wherein said process cartridge containing the magnetic developer includes a magnet in said developer carrying member and a regulating member for regulating a thickness of a layer of the developer on said developer carrying member.

14. A process cartridge according to claim 11, wherein said developer carrying member has a cylindrical member having an outside diameter which is different depending on whether the magnetic developer is used or whether the non-magnetic developer is used.

15. An apparatus according to claim 14, wherein said first and second drive transmitting portions have different drive transmitting means.

16. A cartridge according to claim 1, wherein said first and second drive transmitting portions comprise helical gears.

17. A cartridge according to claim 1, wherein said third gear is a helical gear.

18. An image forming apparatus, comprising:

a process cartridge detachably mountable to an image forming apparatus, comprising:

a movable image bearing member having first and second drive transmitting portions; a developer carrying member for carrying a developer to supply the developer to said image bearing member, said developer carrying member having a third drive transmitting portion, wherein said third drive transmitting portion is engageable with one of said first drive transmitting portion and said second drive transmitting portion;

supporting means for detachably supporting said process cartridge; and driving means engageable with one of said first and second drive transmitting means of said image bearing member to transmit a driving force to said process cartridge when said process cartridge is mounted in said image forming apparatus by means of said supporting means.

19. An apparatus according to claim 18, wherein said first and second drive transmitting portions comprise helical gears.

20. An apparatus according to claim 18, wherein said third gear is a helical gear.

* * * * *

UNITED STATES PATENT AND TRADEMARK OFFICE

CERTIFICATE OF CORRECTION

PATENT NO. : 5,126,800

DATED : June 30, 1992

INVENTOR(S) : Kazuo SHISHIDO, et al.

It is certified that error appears in the above-identified patent and that said Letters Patent is hereby corrected as shown below:

On title page, item

[73] Assignee:

line 1, "Cannon" should read --Canon--.

COLUMN 2:

line 4, "be" should be deleted;
line 5, "able to" should read --which can--; and
line 42, "transmitting" should read --transmit--.

COLUMN 3:

line 18, "guide 15" should read --guide 16--;
line 60, "and" should be deleted; and
line 64, "back" should read --black--.

COLUMN 4:

line 1, "description" should read --descriptions--;
line 5, "developing" should read --developer--;
line 61, "difference" should be deleted; and
line 66, "timed" should read --times--.

COLUMN 5:

line 13, "gear 13" should read --gear 3--;
line 18, "bear 2" should read --gear 2--;
line 41, "are" should read --can be--;

UNITED STATES PATENT AND TRADEMARK OFFICE

CERTIFICATE OF CORRECTION

PATENT NO. : 5,126,800 Page 2 of 2

DATED : June 30, 1992

INVENTOR(S) : Kazuo SHISHIDO, et al.

It is certified that error appears in the above-identified patent and that said Letters Patent is hereby corrected as shown below:

line 42, "are" should read --can be--;
line 51, "and therefore," should be deleted; and
line 58, "gear 32" should read --gear 2--.

COLUMN 6:

line 56, "Nos." should read --No--.

COLUMN 7:

line 59, "comprises" should read --comprising--.

COLUMN 8:

line 6, "contains" should read --containing--; and
line 39, "portions; a" should read --portions; ¶ a--.

Signed and Sealed this

Ninth Day of March, 1993

*Attest:*

STEPHEN G. KUNIN

*Attesting Officer*

*Acting Commissioner of Patents and Trademarks*